US005278017A

United States Patent [19]

Tsujihiro

[11] Patent Number: 5,278,017

[45] Date of Patent: Jan. 11, 1994

[54] ELECTRIC CHARGE CONTROLLING RESIN, TONER MADE WITH THE USE OF THE SAME AND METHOD OF PRODUCING THE TONER

[75] Inventor: Masami Tsujihiro, Katano, Japan

[73] Assignee: Mita Industrial Co., Ltd., Osaka, Japan

[21] Appl. No.: 566,469

[22] PCT Filed: Dec. 28, 1989

[86] PCT No.: PCT/JP89/01339

§ 371 Date: Aug. 21, 1990

§ 102(e) Date: Aug. 21, 1990

[87] PCT Pub. No.: WO90/07731

PCT Pub. Date: Jul. 12, 1990

[30] Foreign Application Priority Data

Dec. 28, 1988 [JP] Japan ..... 63-331090
Dec. 28, 1988 [JP] Japan ..... 63-331091

[51] Int. Cl.[5] ..... G03G 9/00

[52] U.S. Cl. ..... 430/110; 430/109; 430/138; 430/546; 430/631; 428/402.24; 427/213.36

[58] Field of Search ..... 430/110, 109, 138, 546, 430/631, 634, 636; 428/402.24; 427/213.36

[56] References Cited

U.S. PATENT DOCUMENTS 4,610,945 9/1986 Matsuoka et al. .
4,883,735 11/1989 Watanabe et al. ..... 430/110

FOREIGN PATENT DOCUMENTS 0276963 8/1988 European Pat. Off. .
0330287 8/1989 European Pat. Off. .
2083051 3/1982 United Kingdom .

*Primary Examiner*—Marion E. McCamish
*Assistant Examiner*—S. Rosasco
*Attorney, Agent, or Firm*—Beveridge, DeGrandi, Weilacher & Young

[57] ABSTRACT

The present invention provides electric charge controlling resin formed with the use of a polymer which has a polar group for imparting an electrostatic charge and of which flow rate Rf as measured by a thin-layer chromatography using silica gel as an adsorbent and ethyl acetate as a developing solvent, is in a range from 0.5 to 1.0. Toner may be prepared by mixing and dispersing the electric charge controlling resin in a binding resin, or by suspension-polymerizing a polymerizable composition under the condition where the electric charge controlling resin is contained in the composition to obtain a binding resin. The toner thus prepared is excellent in the electrostatic chargeability, humidity resistance, coloring properties and reproducibility.

7 Claims, 4 Drawing Sheets

ELECTRIC CHARGE CONTROLLING RESIN, TONER MADE WITH THE USE OF THE SAME AND METHOD OF PRODUCING THE TONER

FIELD OF THE INVENTION

The present invention relates to (i) electric charge controlling resin for adjusting the electrostatic chargeability of toner used for developing an electrostatic latent image, (ii) toner made with the resin and (iii) a method of producing the toner.

BACKGROUND OF THE INVENTION

In the field of electrophotographic copying or electrostatic printing, it is a common practice to use, for developing an electrostatic latent image, toner in the form of colored resin particles containing coloring agents and electric charge controlling agents dispersed in a resin medium.

Generally, the toner is composed of resin particles containing coloring agents, electric charge controlling agents and the like as mixed and dispersed in binding resin. To provide the toner with desired color and electrostatic chargeability, it is a common practice to suitably change the types and blending amounts of the binding resin, coloring agents, electric charge controlling agents and the like to be used.

As a toner manufacturing method, there is generally adopted a so-called pulverization method by which a resin medium and coloring agents are molten and kneaded to prepare toner in the form of particles having a predetermined range of particle size. However, the toner thus produced by the pulverization method contains particles having irregular shapes and presents a poor fluidity. Further, the individual irregular particles of the toner are electrically, charged in considerably different manners, causing the distribution of electrostatic charge to become broad. Further, the pulverization method requires facilities of great size, resulting in increased production cost.

It is also proposed to manufacture toner by a suspension polymerization method. According to this method, a polymeric composition in the form of a mixture of an initiator of polymerization with toner characteristic imparting agents such as polymeric monomers, coloring agents, electric charge controlling agents and the like, is suspended, under stirring at a high speed, in an aqueous solution containing a dispersion stabilizer. Then, this mixture is polymerized to directly produce toner. This toner manufacturing method using suspension polymerization may directly produce toner in the form of particles of which sizes are in a practical range, at the resin polymerization step. This results in decrease in production cost. Further, this method presents the advantage that the resultant toner is excellent in fluidity and stability of electrostatic charge.

Such a toner manufacturing method using pulverization or suspension polymerization uses an electric charge controlling agent for adjusting the characteristics of toner electrostatic charge. As the electric charge controlling agent, a variety of dyes are generally used. Since the electric charge controlling agent controls the developing properties of the toner, it is important to properly select the electric charge controlling agent.

More specifically, the demands for an image forming apparatus are recently versatile according to applications and are extended to a variety of performances such as smaller-size, lower-energy, higher-speed, multicolors, maintenance-free and the like. Accordingly, to accomodate to the developing system or inside environmental conditions of the apparatus, the toner is required to have different characteristics according to the apparatus types and colors used. Therefore, a great number of types of toner are apt to be produced in a small amount. It is therefore required to manufacture, with good reproducibility, toners of which characteristics are subtly different. In view of the foregoing, the selection of the electric charge controlling agent is important.

However, the dyes are hardly compatible with resin and a polymeric monomer. Accordingly, a great amount of dyes should be added to obtain a sufficient electrostatic charge. Further, since the dyes are present in the form of particles in resin and a polymeric monomer, the electrostatic chargeability of the resultant toner considerably vary with the quality of dispersion of the dyes. Such variations may cause image fog, toner scattering and uneveness of an image quality. Further, when the dyes are used for color toner requiring light permeability, the dyes dispersed in the form of particles inhibits such light permeability, failing to form a clear color image. In addition, the dyes are generally expensive, leading to increase in production cost.

In view of the foregoing, to uniformly stabilize the characteristics of toner electrostatic charge, in particular to improve the starting electrostatic chargeability, it is proposed to mix and uniformly disperse binding resin and a copolymer, serving as electric charge controlling resin, composed of (i) a monomer having a polar group and (ii) an oil-soluble monomer compatible with the binding resin or a monomer capable of forming the binding resin, so that the electrostatic charges of individual toner particles are made uniform. For example, Japanese Unexamined Patent Publication No. 88564/1988 discloses toner containing a polymer (copolymer) having a sulfonate group connected to an aromatic ring.

It is found that the sulfonate group disclosed in this Publication is excellent in electric charge imparting properties and that the use thereof for toner improves the electrostatic chargeability such as starting and stabilization of the electrostatic charge, and the like.

However, the inventors of the present invention have found the following facts. That is, even though the monomer having a polar group (sulfonate group or the like) and the oil-soluble monomer in the electric charge controlling resin are substantially the same in monomer composition ratio, the dispersibility of the electric charge controlling resin in the binding resin considerably depends on the polymer structure or molecular weight of the electric charge controlling resin which varies with change in production conditions, difference in raw materials used between lots, and the like. This presents the problems that the electrostatic chargeability undergo a change, that the water vapor resisting properties are lowered, and that the hue varies, failing to repeatedly produce the toner having desired characteristics with good reproducibility.

Consideration is then made on the use of the electric charge controlling resin for manufacturing toner by the suspension polymerization method. The polar group for controlling the electric charge of the electric charge controlling resin is also water-soluble. Accordingly, when the electric charge controlling resin as mixed in a polymeric composition is subjected to suspension polymerization, the electric charge controlling resin is eluted from the suspension oil drops into water. Further, the emulsification by the water-soluble polar group of the electric charge controlling resin thus eluted, causes a by-product in the form of particles with 1 μm or less to be produced. This may not only reduce the productivity, but also deteriorate the electrostatic chargeability, durability and water vapor resistance of the toner.

It is a main object of the present invention to provide electric charge controlling resin excellent in electric charge imparting properties and dispersion in binding resin.

It is another object of the present invention to provide electric charge controlling resin which is adapted not to be eluted in an aqueous phase in a suspension polymerization step while being maintained in suspension oil drops until the polymerization is complete, and which may be uniformly and evenly dispersed in the oil drops.

It is a further object of the present invention to provide a toner producing method capable of manufacturing toner having improved durability with good productivity and without production of a by-product in the form of particules at a suspension polymerization step.

It is still another object of the present invention to provide electric charge controlling resin capable of imparting uniform and highly reproducible electrostatic chargeability.

It is a still further object of the present invention to provide toner having desired characteristics and a method of producing such toner in a system of producing a great number of types of toner in a small amount.

It is yet another object of the present invention to provide toner which may be economically produced with increased productivity, and a method of economically producing such toner with increased productivity.

It is a yet further object of the present invention to provide toner which is excellent in starting and stability of electrostatic charge and light permeability, and which is also excellent in coloring properties and water vapor resistance, and to provide a method of producing such toner.

DISCLOSURE OF THE INVENTION

The present invention provides electric charge controlling resin formed with the use of a polymer which has a polar group for imparting an electrostatic charge and of which flow rate Rf is in a range from 0.5 to 1.0, this flow rate Rf being measured by a thin-layer chromatography using silica gel as an adsorbent and ethyl acetate as a developing solvent.

In the electric charge controlling resin of the present invention, the flow rate Rf as measured by a thin-layer chromatography is in the range above-mentioned, so that the hydrophilic and lipohilic property of the polymer itself are in a preferred state. According to the present invention, such flow rate Rf serves as an index of lipohilic property.

In actual production of the electric charge controlling resin, a polymer as obtained through a polymerization reaction is used as a raw material of toner after it has been made sure that the polymer presents the flow rate Rf in the range above-mentioned. Dissolving the obtained polymer in a water-soluble organic solvent, and loading the resultant solution into water to remove the components of the polymer apt to be dissolved in water, the flow rate Rf is more suitable.

First toner in accordance with the present invention may be prepared by mixing and dispersing such electric charge controlling resin in binding resin. If the flow rate Rf of the polymer forming the electric charge controlling resin is less than 0.5, the hydrophilic property of the polymer is so strong that the dispersion of the electric charge controlling resin in the binding resin becomes uneven. This produces toner particles of which electrostatic charges are excessively great or less. The variations of the toner characteristics due to dispersion is wide, so it becomes difficult to adjust the toner characteristics to the desired characteristics by adjusting the blending ratio, failing to manufacture desired toner with good reproducibility.

According to the first toner, the dispersed and mixed electric charge controlling resin has hydrophilic and lipohilic property in a preferred state. Thus, the toner is excellent in the electrostatic chargeability, water vapor resistance, coloring properties and reproducibility. It is therefore possible to produce, with high reliability, toners having a variety of performances suitable for various systems, by suitably determining amounts of components such as electric charge controlling resin and the like to be added to the binding resin.

Second toner of the present invention may be manufactured by suspension polymerization using the electric charge controlling resin. That is, binding resin as containing the electric charge controlling resin is subjected to suspension polymerization.

The suspension polymerization may be carried out with the electric charge controlling resin mixed added to a polymeric composition which contains polymeric monomers and coloring agents.

More specifically, the electric charge controlling properties of the electric charge controlling resin are determined, to a certain extent, by the number of polar groups in the polymer (in a copolymer, by the composition ratio of the monomer having a polar group to the oil-soluble monomer). However, the dispersion quality of the electric charge controlling resin at the time of suspension polymerization, i.e., the relationship between the solubility of the electric charge controlling resin in a water phase and the compatibility thereof with the polymeric monomer, varies with the structure, molecular weight and polymerization conditions of the copolymer, difference in raw materials used between lots and the like. Accordingly, the preferred conditions of the electric charge controlling resin used for suspension polymerization have not been conventionally grasped well. According to the present invention, the use of the particular electric charge controlling resin mentioned above, not only improves the compatibility with the polymeric monomers forming oil drop particles, but also prevents the resin from being dissolved in a water phase. Thus, the electric charge controlling resin is uniformly dispersed in oil drop particles. Further, the polymerization may proceed with the electric charge controlling resin existing on the surfaces of the oil drops without the electric charge controlling resin eluted in a water phase. It is therefore possible to prepare spheric toner particles of which difference in characteristics is small and which are excellent in the electrostatic chargeability, durability and water vapor resistance. The following description will discuss in detail the present invention.

Electric Charge Controlling Resin

In the electric charge controlling resin of the present invention, examples of the polar group for imparting an electrostatic charge include a sulfonate group, a carboxylate group, an amine salt group and the like. Preferably, there is used a sulfonate group represented by $-SO_3X$ (wherein X is a sodium element, a potassium element or a calcium element).

The polymer forming the electric charge controlling resin may be a monopolymer. Preferably, this polymer is a copolymer as obtained by a polymerization reaction such as bulk polymerization, suspension polymerization, solution polymerization, emulsion polymerization, dispersion polymerization or the like, of a monomer having a polar group (a sulfonate group) and an oil-soluble monomer.

Examples of the monomer having the sulfonate group include salts such as sodium, potassium, calcium and the like of styrene sulfonic acid, vinyl sulfonic acid, methyl propane sulfonic acid, methacrylsulfonic acid or the like. Of these, styrene-sodium sulfonic acid produces preferred results.

As the oil-soluble monomer, there may be suitably selected a monomer excellent in compatibility with the binding resin for producing the first toner, or a monomer excellent in compatibility with monomer components forming the binding resin for producing the second toner by suspension polymerization. Generally, the same oil-soluble monomer may be used as the oil-soluble monomer used for the first toner and as the oil-soluble monomer used for the second toner.

Examples of the oil-soluble monomer include vinyl aromatic hydrocarbon, an acrylic monomer, a vinyl ester monomer, a vinyl ether monomer, a diolefin monomer, a monoolefin monomer and the like.

The vinyl aromatic hydrocarbon may be represented by the following formula (1):

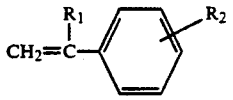

(1)

(wherein $R_1$ is a hydrogen atom, a lower alkyl group or a halogen atom, and $R_2$ is a hydrogen atom, a lower alkyl group, a halogen atom, an alkoxy group, a nitro group or a vinyl group).

Examples of the vinyl aromatic hydrocarbon above-mentioned include styrene, α-methylstyrene, vinyl toluene, α-chlorostyrene, o-, m-, p-chlorostyrene, p-ethylstyrene, divinyl benzene and the like. These substances may be used either alone or in combination of plural types.

The acrylic monomer may be represented by the following formula (2):

$$CH_3{=}\overset{R_3}{\overset{|}{C}}{-}CO{-}O{-}R_4 \qquad (2)$$

(wherein $R_3$ is a hydrogen atom or a lower alkyl group, and $R_4$ is a hydrogen atom, a hydrocarbon group having 1 to 12 carbon atoms, a hydroxy alkyl group, or a vinyl ester group).

Examples of the acrylic monomer above-mentioned include methyl acrylate, ethyl acrylate, butyl acrylate, 2-ethylhexyl acrylate, cyclohexyl acrylate, phenyl acrylate, methyl methacrylate, hexyl methacrylate, 2-ethylhexyl methacrylate, β-hydroxy ethyl acrylate, γ-hydroxy propyl acrylate, α-hydroxy butyl acrylate, β-hydroxy ethyl methacrylate, ethylene glycol ethyl methacrylate, tetra methylene glycol ester dimethacrylate and the like.

The vinyl ester monomer includes vinyl esters represented by the following formula (3):

$$CH_2{=}\underset{\underset{O}{\|}}{\overset{\overset{O}{|}}{C}}{-}R_5 \qquad (3)$$

(wherein $R_5$ is a hydrogen atom or a lower alkyl group).

Examples thereof include vinyl formate, vinyl acetate, vinyl propionate and the like.

The vinyl ether monomer is vinyl ether represented by the following formula (4):

$$CH_2{=}\overset{\overset{O}{|}}{C}H{-}R_6 \qquad (4)$$

(wherein $R_6$ is a mono hydrocarbon group having 1 to 12 carbon atoms).

Examples of the vinyl ether above-mentioned include vinyl-n-butyl ether, vinyl phenyl ether, vinyl cyclohexyl ether and the like.

The diolefin monomer is diolefins represented by the following formula (5):

$$CH_2{=}\overset{R_7}{\overset{|}{C}}{-}\overset{R_8}{\overset{|}{C}}{=}CH{-}R_9 \qquad (5)$$

(wherein $R_7$, $R_8$ and $R_9$ may be the same or different, and each is a hydrogen atom, a lower alkyl group or a halogen atom). Examples of the diolefins above-mentioned include butadiene, isoprene, chloroprene and the like.

The monoolefin monomer is monoolefins represented by the following formula (6):

$$CH_2{=}\overset{R_{10}}{\overset{|}{C}}{-}R_{11} \qquad (6)$$

(wherein $R_{10}$ and $R_{11}$ may be the same or different, and each is a hydrogen atom or a lower alkyl group.) Examples of the monoolefins above-mentioned include ethylene, propylene, isobutylene, butene-1, pentane-1, 4-methyl pentane-1 and the like.

Of these, the styrene monomer and the acrylic monomer are preferred.

The blending ratio of the oil-soluble monomer to the monomer having a polar group such as the sulfonate group or the like depends on the monomers used, but may be generally selected in a range from 30:70 to 1:99, and preferably from 20:80 to 2:98. Then, the monomers are subjected to a polymerization reaction such as bulk polymerization, suspension polymerization, solution polymerization, emulsion polymerization, dispersion polymerization or the like, thereby to produce a copolymer. The molecular weight of the copolymer may be adjusted such that the average molecular weight is in a range from $10^3$ to $10^6$. The average molecular weight is preferably in a range from about $10^4$ to about $10^6$ for making the first toner, and in a range from about 103 to about 50000 for making the second toner.

Preferably, the structure of the copolymer is a random copolymer or an alternating copolymer.

Preferably, the production of the electric charge controlling resin is made by the dispersion polymerization out of the polymerization methods above-mentioned for the following reasons.

That is, most of polymers and monomers having a polar group present a low compatibility with the monomer for forming a polymer having a high compatibility with binding resin. Accordingly, when the bulk polymerization or the suspension polymerization is applied, the monomers are apt to become uneven before or during the polymerization. Accordingly, there may be easily produced a copolymer containing a great number of monomer units having a polar group and having no compatibility with the binding resin.

The solution polymerization presents the similar problem as in the bulk polymerization. However, when a suitable solvent is selected, a uniform system may be obtained before the polymerization. However, even in the solution polymerization, when the polymerization proceeds, the polymer is apt to be separated out and the composition of the polymer thus separated out is apt to be uneven. To control the separating of the polymer in the solution polymerization, it is required to minimize the hold-up or to lower the ratio of the polar monomers.

According to the emulsion polymerization, it is relatively easy to control the composition of the monomer units of a copolymer to be produced. However, the molecular weight is increased to lower the compatibility with the binding resin.

In the dispersion polymerization, a mixture medium of water and a water-miscible organic solvent is used as a polymerization medium. In this polymerization, the water naturally dissolves a water-soluble monomer, and the water-miscible organic solvent dissolves the oil-soluble medium. Both-type monomers are dissolved in the mixture medium, thereby to form a homogenized solution phase.

At the initial stage of polymerization, the reaction proceeds in the form of a solution polymerization to produce a copolymer of which molecular weight is low and which has the composition of monomer units according to the reactivity ratio. When the reaction further proceeds, the copolymer is apt to be separated out. However, since a dispersion stabilizer is present, some particles of the copolymer become relatively stable dispersible particles. These dispersible particles are a copolymer of the oil-soluble monomer and the water-soluble monomer. Accordingly, the water-soluble monomer and the oil-soluble monomer which have not yet been reacted in a continuous phase, are simultaneously absorbed, thereby to produce a copolymer having a relatively even composition.

Examples of the water-miscible organic solvent used for the dispersion polymerization include: lower alcohols such as methanol, ethanol, isopropanol or the like; ketones such as acetone, methyl ethyl ketone, methyl butyl ketone or the like; ethers such as tetrahydrofuran, dioxane or the like; esters such as ethyl acetate or the like; and amides such as dimethylformamide or the like. These substances may be suitably selected and used according to the types of the monomers used.

The blending ratio by weight of the water to the water-miscible organic solvent depends on the types of the solvent and the monomers used, but is generally in a range from 40:60 to 5:95, and preferably in a range from 30:70 to 10:90. This ratio may be so selected as to form a uniform solution phase in its entirety. The blending ratio by weight of the mixture medium to the monomers is in a range from 0.5 to 50 times per monomer, and preferably in a range from 5 to 25 times.

The dispersion stabilizer is a polymeric dispersion stabilizer soluble in the mixture medium mentioned above. Preferred examples of the dispersion stabilizer include polyacrylic acid, polyacrylate, polymethacrylic acid, polymethacrylate, a (metha)acrylic acid-(metha)acrylic ester copolymer, an acrylic acidvinyl ether copolymer, a methacrylic acid-styrene copolymer, carboxymethylcellulose, polyethylene oxide, polyacrylamide, methylcellulose, ethylcellulose, hydroxyethylcellulose, polyvinyl alcohol and the like. A nonionic or anionic surface active agent may also be used. In the system, the dispersion stabilizer may be used at a ratio of 0.01 to 10% by weight, and preferably 0.1 to 3% by weight.

As the initiator of polymerization, there may be used an initiator soluble in a water-insoluble monomer, including (i) an azo compound such as azobisisobutyronitrile and the like and (ii) peroxide such as cumene hydroperoxide, t-butylhydroperoxide, dicumyl peroxide, di-t-butylperoxide, benzoyl peroxide, lauroyl peroxide and the like. In addition, there may be used a combination of ultraviolet rays or ionized radiation such as $\gamma$-rays, accelerating electron beams with any of a variety of light sensitizer.

The blending amount of the initiator of polymerization such as the azo compound, peroxide or the like may be a so-called proper catalytic amount, and is generally in a range from 0.1 to 10% by weight per charge monomer. As the polymerization temperature and time, there may be applied conventional temperature which is generally in a range from 40° to 100° C., and conventional time which is generally in a range from 1 to 50 hours. The reaction system may be stirred in a moderate manner such that the generally homogenized reaction is achieved. To prevent the polymerization from being restrained by oxygen, the reaction system may be polymerized with the atmosphere replaced with an inert gas such as nitrogen.

According to this polymerization, the electric charge controlling resin may be obtained in the form of particles generally having a relatively uniform distribution of particle size from 0.01 to 10 $\mu$m, and preferably from 0.1 to 7 $\mu$m.

Further preferred results may be produced in the following manner. That is, the resultant polymerization product may be dissolved in a suitable water-soluble organic solvent such as tetrahydrofuran, dioxane, dimethyl sulfoxide, acetone or the like. The resultant solution may be loaded in water, so that the polymeric components apt to be dissolved in water are removed. After filtered off or centrifugalized, the residue may be dried to produce the electric charge controlling resin. The flow rate Rf of the electric charge controlling resin thus produced is measured by the thin-layer chromatography mentioned above. It is then checked whether or not the spot position appears in a range from 0.5 to 1.0. Based on the result, the characteristics of the electric charge controlling resin are evaluated. Preferred is the electric charge controlling resin in which the spot position appears in a range from 0.7 to 1.0.

Production of the First Toner

Together with additives such as coloring agents and the like, the electric charge controlling resin thus obtained is contained in binding resin.

Examples of the binding resin include: an olefin polymer such as a styrene polymer, an acrylic polymer, a styrene-acryl copolymer, chlorinated polyethylene, polypropylene, ionomer or the like; and a variety of polymers such as polyvinyl chloride, polyester, polyamide, polyurethane, epoxy resin, diallylphthalate resin, phenol resin, rosin modified maleic acid resin, rosin ester, petroleum resin and the like. Preferably, the binding resin is mainly composed of a styrene polymer, an acrylic polymer or a styrene-acrylic polymer. The polymer has an average molecular weight in a range from 30000 to 250000, and preferably from 50000 to 200000. The polymers above-mentioned may be used either alone or in combination of plural types.

Among the polymers, rosin ester, rosin modified phenol resin, rosin modified maleic acid resin, epoxy resin, polyester, a fibrous polymer, polyeter resin and the like are advantageous for improving the frictional electrostatic charge characteristics of toner.

In view of the fixing properties and durability, there may be used the polymers having a softening point in a range from 50° to 200° C., and preferably from 70° to 170° C.

Examples of the coloring agents include the following pigments and dyes.

Black Pigment

Carbon black, Acetylene black, Lamp black, Aniline black

Yellow Pigment

Chrome yellow, Zinc yellow, Cadmium yellow, Yellow oxide of iron, Mineral fast yellow, Nickel titanium yellow, Navel's yellow, Tephthol yellow S, Hansa yellow 10G, Benzidine yellow-G, Quinoline yellow lake, Permanent yellow NGG, Tartrazine lake.

Orange Pigment Chrome orange, Molybdenum orange, Permanent orange GTR, Pyrazolone orange, Vulcan orange, Indanthrene brilliant orange RK, Benzidine orange G, Indanthrene brilliant orange GK Red Pigment Red iron oxide, Cadmium red, Red lead, Cadmium mercury, Permanent Orange 4R, Lithol red, Pyrazolone red, Watching red calcium salt, Lake red D, Brilliant carmine 6B, Eosine lake, Rhodamine lake B, Alizarine lake, Brilliant carmine 3B Violet Pigment Manganese violet, Fast violet B, Methyl violet lake Blue Pigment Prussian blue, Cobalt blue, Alkali blue lake, Victoria blue lake, Phthalocyanine blue, Metal-free phthalocyanine blue, Partially chlorinated phthalocyanine blue, Fast sky blue, Indanthrene blue BC Green Pigment Chrome green, Chrome oxide, Pigment green B, Malachite green lake, Fanal yellow green G White Pigment Zinc white, Titanium oxide, White of antimony, Zinc sulfide Extender Pigment Pearlite powder, Barium carbonate, Clay, Silica, White carbon, Talc, Aluminum white As magnetic material pigments, there are known triiron tetroxide ($Fe_3O_4$), iron sesquioxide ($\gamma$-$Fe_2O_3$), zinc iron oxide ($ZnFe_2O_4$), yttrium iron oxide ($Y_3Fe_5O_{12}$), cadmium oxide ($Cd_3Fe_5O_{12}$), copper iron oxide ($CuFe_2O_4$), lead iron oxide ($PbFe_{12}O_{19}$), neodymium iron oxide ($NdFeO_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron powder (Fe), cobalt powder (Co), nickel powder (Ni) and the like. According to the present invention, any fine powder of these known magnetic materials may be used.

The blending ratio of the coloring agents to the binding resin may be considerably changed, but is generally in a range from 1 to 20 parts by weight per 100 parts by weight of the binding resin, and preferably from 3 to 10 parts by weight per 100 parts by weight of the binding resin.

To impart toner fixing properties and off-set preventing properties, there may be used (i) any type of a variety of waxes including polypropylene having a low molecular weight, polyethylene having a low molecular weight, paraffin wax and the like, (ii) an olefin polymer having a low molecular weight containing an olefin monomer having 4 or more carbon atoms, (iii) fatty acid amide, or (iv) silicone oil or the like, at a ratio of 0.1 to 10 parts by weight and preferably 1 to 5 parts by weight per 100 parts by weight of the binding resin.

There may be jointly used, as necessary, a conventional electric charge controlling agent such as metal-containing azo dyes, pyrimidine compounds, metallic chelates of alkyl salicylic acid and the like, in such an amount as not to produce any problem due to defective dispersion.

There are molten and kneaded, together with additivies such as coloring agents and the like, the binding resin and the electric charge controlling resin having flow rate Rf of 0.5 to 1.0 as measured by the thin-layer chromatography mentioned above. After cooled, the resultant mixture is pulverized and classified, thereby to produce the first toner. Alternately, the first toner may be obtained by other method such as a spray dry method.

The toner thus obtained may be subjected, as necessary, to surface treatment with fine particles of: carbon black; hydrophobic silica; metal oxide such as aluminum oxide and the like; fatty acid metallic salt such as zinc stearate, zinc palmitate and the like; and resin such as an acrylic polymer and the like, thereby to produce the final toner.

Production of the Second Toner (suspension polymerization)

As the polymeric monomer which may form the binding resin forming the polymerizable composition, there may be used a polymerizable monomer compatible with the oil-soluble monomer forming the electric charge controlling resin. Examples of such a polymerizable monomer include vinyl aromatic hydrocarbon, an acrylic monomer, a vinyl ester monomer, a vinyl ether monomer, a diolefin monomer, a monoolefin monomer and the like, similar to the oil-soluble monomer above-mentioned.

There may be used coloring agents to be added to the polymerizable composition which are similar to those used for making the first toner.

In polymerization, the polymerizable composition composed of the electric charge controlling resin, the polymerizable monomer forming the binding resin, coloring agents and the like, is loaded in a water phase and subjected to suspension and dispersion, thereby to form oil drop particles. A dispersion stabilizer may be used to stabilize the particles in the micron order without the oil drop particles agglomerated.

A conventional dispersion stabilizer may be used. It is possible to use, as the dispersion stabilizer, a water-soluble polymer such as polyvinyl alcohol, methylcellulose or the like, and a surface active agent of the nonionic type or the ionic type. However, fine powder of water-solution-retardant inorganic salt are preferred because they may stably maintain the oil drops in the form of fine particles without no restrictions imposed on the stirring speed, the blending amount and the like. Examples of such salt include calcium phosphate, sodium phosphate, magnesium carbonate, barium carbonate, calcium carbonate, aluminum hydroxide and the like. Of these, the salt of phosphate is preferred in view of excellent stability of particles and easy removal from the produced polymerizable particles. When water-solution-retardant inorganic salt is used, the joint use of a surface active agent may increase the stability.

The dispersion stabilizer may be used at a ratio of 1 to 50% by weight per water and preferably 10 to 25% by weight. The surface active agent is preferably used at a ratio of 0.01 to 0.1% by weight per water.

The suitable stirring speed applied at the time of suspension is generally in a range from 5000 to 15000 rpm.

The amount of the dispersion stabilizer and the stirring speed may be suitably adjusted such that the particle sizes of the suspension oil drops are in a range from 5 to 30 μm, and preferably from 8 to 12 μm.

As the initiator of polymerization, there may be used an oil-soluble initiator of which examples include an azo compound such as azobisisobutyronitrile and the like, and peroxide such as cumene hydroperoxide, t-butylperoxide, dicumyl peroxide, di-t-butylperoxide, benzoyl peroxide, lauroyl peroxide and the like.

The blending amount of the initiator of polymerization such as the azo compound, the peroxide or the like is a so-called proper catalyst amount which is generally in a range from 0.1 to 10% by weight per charge monomer. As the polymerization temperature and time, there may be applied conventional temperature which is generally in a range from 40° to 100° C., and conventional time which is generally in a range from 1 to 50 hours. The reaction system may be stirred in a moderate manner such that a homogenized reaction occurs in the entirety of the system. To prevent the polymerization from being restrained due to oxygen, the reaction system may be polymerized with the atmosphere replaced with an inert gas such as nitrogen or the like. According to the present invention, additive components preferred to be contained in the toner may be previously blended in the polymerizable composition together with the coloring agents and the electric charge controlling resin, prior to the polymerization. For example, dyes may be added in order to stabilize the atmosphere or to facilitate the starting of electrostatic charge. Further, to prevent the off-set, it is possible to add polyethylene of low molecular weight, polypropylene of low molecular weight, a variety of waxes, silicone oil or the like. Such additive components may be added in such small amounts as to exert no influences upon the polymerization and the characteristics of the particles to be produced.

After reaction, the polymerized product is obtained in the form of spherical particles of which sizes are in the range mentioned above and on the surfaces of which the polar group for controlling the electric charge is uniformly present. The produced particles are filtered off and washed with water, acid, alkali or a suitable solvent, as necessary. The particles are then dried, thus producing toner particles.

The toner particles thus obtained may be covered, as necessary, with fine particles of metallic oxide such as carbon black, hydrophobic silica, aluminum oxide or the like, or fine particles of resin such as an acrylic polymer or the like, thus producing the final toner.

Industrial Applicability

When producing the first toner with the use of the electric charge controlling resin of the present invention, the electric charge controlling resin excellent in dispersion in the binding resin may be previously selected prior to its mixing to the binding resin. Accordingly, it is possible not only to prevent the production of defective toner, but also to produce, with good reproducibility, toner excellent in the rising and stability of electrostatic charge and water vapor resistance. This results in improvements in production efficiency, thus achieving easy production of various toners suitable for a variety of systems with low cost.

When producing the second toner with the use of the electric charge controlling resin of the present invention, there may be produced, with good reproducibility and without production of by-product particles, durable spheric toner of which particle size distribution is sharp, of which the starting of electrostatic charge is fast and of which electrostatic charge distribution curve is also sharp. Accordingly, there is no likelihood that defective toner is produced, resulting in decrease in production cost.

Examples

The following description will discuss the present invention in detail with reference to Examples thereof and Comparative Examples.

Example 1 (production of electric charge controlling resin)

Figure 1:
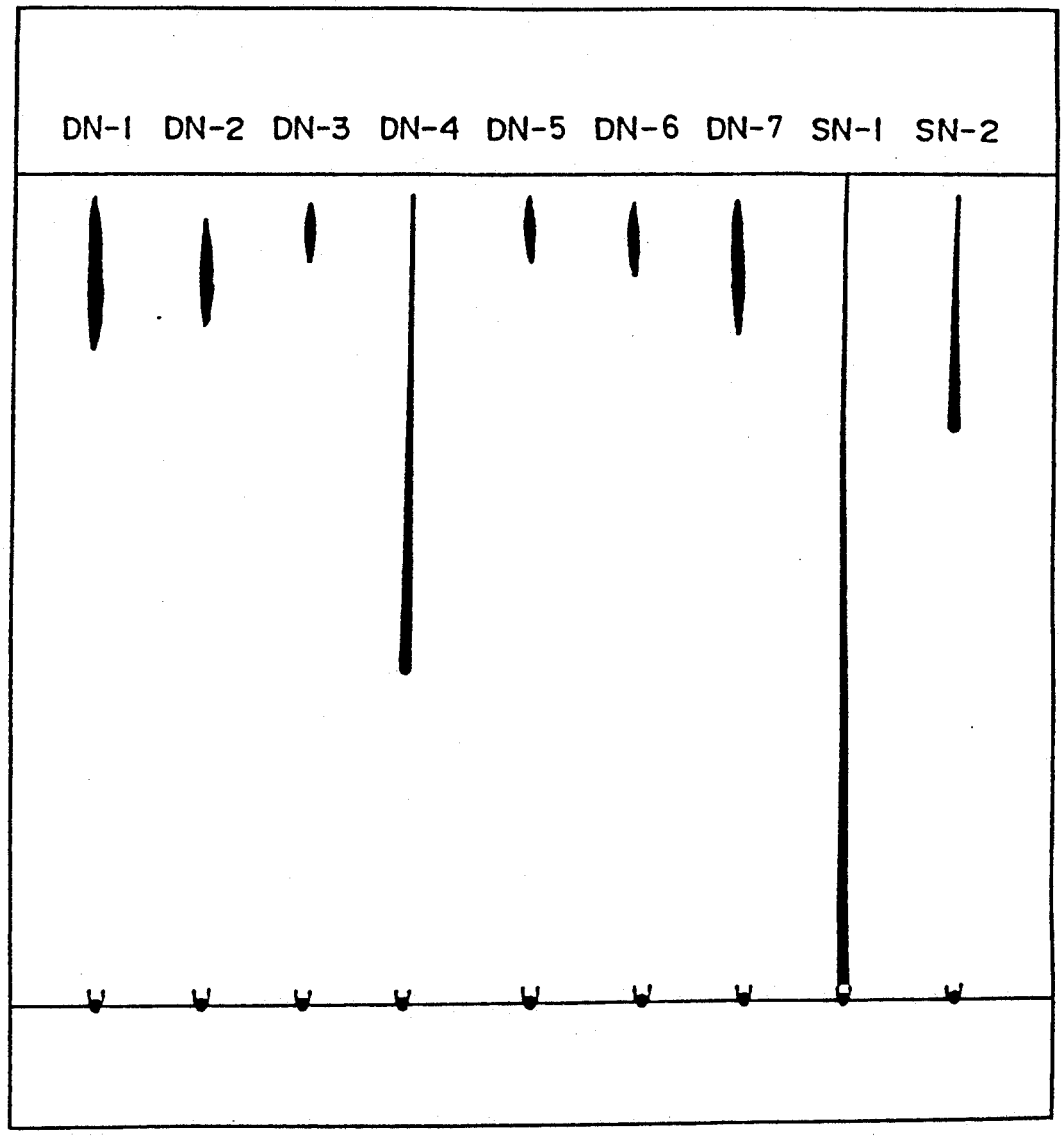
FIG. 1 is a view illustrating developed spots of electric charge controlling resins used in Examples and Comparative Examples, as obtained by a thin-layer chromatography.

According to the prescriptions shown in Table 1, styrene, styrene-sodium sulfonic acid, polyacrylic acid and azoisobutyronitrile were dissolved in an alcohol-water mixed solvent. While being stirred under a stream of nitrogen in a separable flask at 150 rpm, the mixtures were respectively reacted at temperatures shown in Table 2 for 12 hours, thus completing the polymerization. The resultant emulsions were centrifugalized to separate the particles therein, thus preparing powders of styrene-styrene sodium sulfonic acid copolymers DN-1 to DN-7. FIG. 1 shows spots of the respective samples of the copolymers as developed according to a thin-layer chromatography with the use of silica gel as an adsorbent and ethyl acetate as a developing solvent.

Table 2 also shows the average molecular weights and Rf values of DN-1 to DN-7.

TABLE 1 (1/2)

| | (unit: % by weight) | | | |
|---|---|---|---|---|
| | DN-1 | DN-2 | DN-3 | DN-4 |
| Styrene | 9.0 | 9.0 | 9.0 | 9.0 |
| Styrene-sodium sulfonic acid | 1.0 | 1.0 | 1.0 | 1.0 |
| Isopropyl alcohol | | | 65.8 | 79.9 |
| Methanol | 66.6 | 66.6 | | |
| Water | 22.2 | 22.2 | 22.2 | 8.9 |
| Polyacrylic acid | 1.0 | 1.0 | 1.0 | 1.0 |
| Azobisiso-butyronitrile | 1.0 | 1.0 | 1.0 | 0.2 |

TABLE 1 (2/2)

| | (unit: % by weight) | | |
|---|---|---|---|
| | DN-5 | DN-6 | DN-7 |
| Styrene | 9.0 | 9.0 | 9.0 |
| Styrene-sodium sulfonic acid | 1.0 | 1.0 | 1.0 |
| Isopropyl alcohol | 65.8 | 65.8 | |
| Methanol | | | 66.6 |
| Water | 22.2 | 22.2 | 22.2 |
| Polyacrylic acid | 1.0 | 1.0 | 1.0 |
| Azobisiso-butyronitrile | 1.0 | 1.0 | 1.0 |

TABLE 2 (1/2)

| | DN-1 | DN-2 | DN-3 | DN-4 |
|---|---|---|---|---|
| Gross weight of polymerizable composition (g) | 2500 | 4000 | 2500 | 2500 |
| Flask capacity (liter) | 3 | 5 | 3 | 3 |
| Polymerization temperature (°C.) | 60 | 60 | 80 | 70 |
| Average molecular weight | $8.7 \times 10^5$ | $8.4 \times 10^5$ | $2.6 \times 10^3$ | $9.5 \times 10^4$ |
| Rf | 0.84–0.99 | 0.86–0.97 | 0.92–0.99 | 0.42–0.99 |

TABLE 2 (2/2)

| | DN-5 | DN-6 | DN-7 |
|---|---|---|---|
| Gross weight of polymerizable composition (g) | 2500 | 4000 | 2500 |
| Flask capacity (liter) | 3 | 5 | 3 |
| Polymerization temperature (°C.) | 80 | 80 | 60 |
| Average molecular weight | $2.6 \times 10^3$ | $8.4 \times 10^3$ | $8.7 \times 10^5$ |
| Rf | 0.94–0.99 | 0.92–0.97 | 0.86–0.99 |

Example 2 (production of the first toner)

| (Component) | (Quantity) |
|---|---|
| DN-1 (Rf value: 0.84–0.99) | 10 parts by weight |
| Styrene-Acryl copolymer (Tg = 65, Mn = 10000, Mw = 120000) | 80 parts by weight |
| C.I. Solvent Blue 25 | 10 parts by weight |

Figure 2:
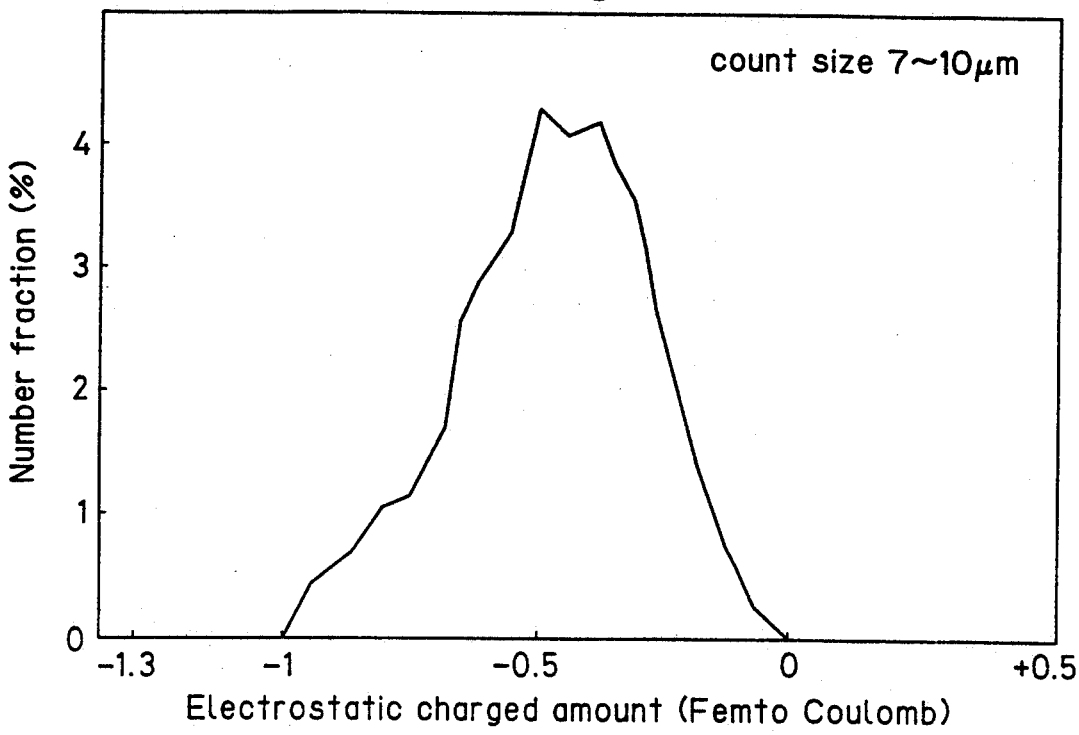
FIGS. 2 and 3 are graphs illustrating the electrostatic charge distribution curves of the toners of Example 2 and Comparative Example 1, respectively.

The components above-mentioned were dissolved, kneaded, pulverized and classifed, thereby to produce toner having the average particle size of 10 μm. The toner thus produced was mixed with a ferrite carrier to produce a developer. This developer presented the toner electrostatic charge of −36 μc/g as measured according to a blow-off method. The distribution of the toner electrostatic charge as measured with apparatus for measuring the electrostatic charge of toner, was sharp as shown in FIG. 2, which shows no toner particles presenting excessively great or less electrostatic charges.

With the use of an OHP film, a copying test was conducted on this developer as mounted on the electrophotographic copying apparatus DC-1205 (manufactured by Mita Kogyo Co., Ltd.). The image obtained was excellent in light permeability with a good image quality.

Example 3 (production of the first toner)

Toner was prepared in the same manner as in Example 2 except that 10 parts by weight of the DN-2 (Rf value : 0.86 to 0.97) was used instead of the DN-1 used in Example 2. This toner presented the amount of electrostatic charge of −38 μc/g as measured according to the blow-off method. Likewise in Example 2, the distribution curve of electrostatic charge was sharp and there were observed no toner particles presenting excessively great or small electrostatic charges.

Likewise as in Example 2, a copying test was conducted on this toner. The image obtained was excellent in light permeability with a good image quality.

Example 4 (production of the first toner)

Toner was prepared in the same manner as in Example 2 except that 10 parts by weight of the DN-3 ($Mw=2.6\times10^3$) (Rf value : 0.92 to 0.99) was used instead of the DN-1 ($Mw=8.7\times10^5$) used in Example 2, the DN-3 having a molecular weight smaller than that of the DN-1. This toner presented the same performance as those of the toner of Example 2. However, the materials remarkably sticked to the machine at the steps of preliminary mixing, fine pulverization and classification of the materials.

Likewise, as in Example 2, a copying test was conducted on this toner. The image obtained was excellent in light permeability with a good image quality.

Comparative Example 1 (production of the first toner)

Figure 3:
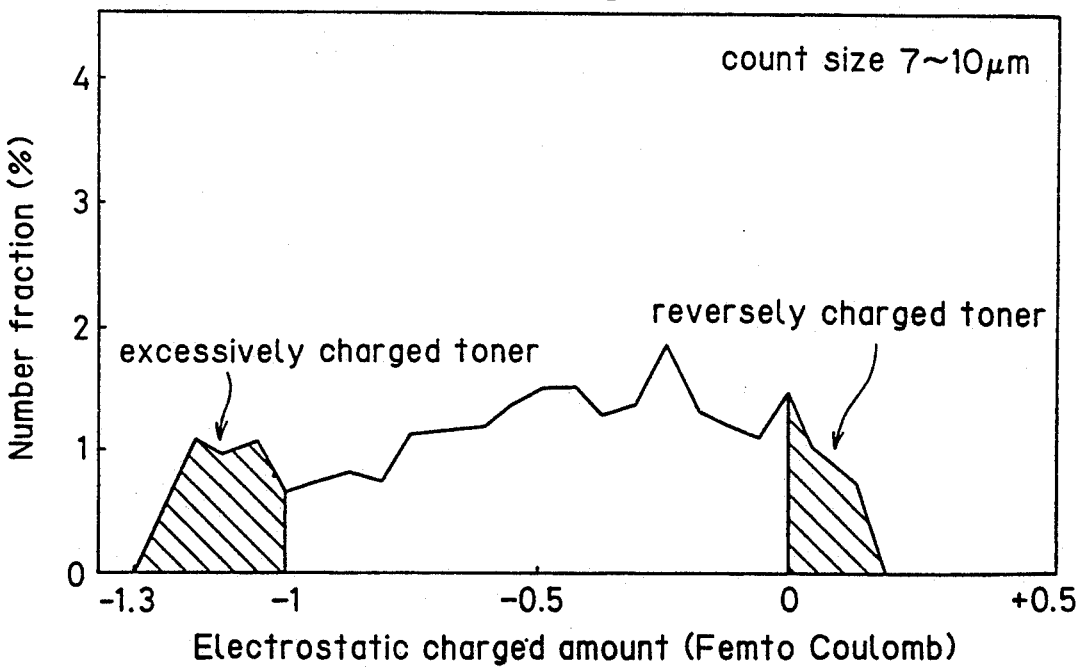

Toner was prepared in the same manner as in Example 2 except that 10 parts by weight of the DN-4 (Rf value : 0.42 to 0.99) was used. This toner presented the electrostatic charge as low as −10 μc/g as measured according to the blow-off method. According to the electrostatic charge distribution of this toner, there were observed a great number of toner particles which were excessively or reversely charged, as shown in FIG. 3.

Likewise as in Example 2, a copying test was conducted on this toner. The image obtained was poor in light permeability and lacked clearness.

Example 5 (production of the electric charge controlling resin)

| (Component) | (Quantity) |
|---|---|
| Styrene | 4.3 parts by weight |
| Styrene-Sodium sulfonic acid | 0.5 parts by weight |
| 1,4-dioxane | 88.3 parts by weight |
| Water | 5.7 parts by weight |
| Azobisisobutyronitrile | 1.2 parts by weight |

The components above-mentioned were mixed. While being stirred under a stream of nitrogen in a separable flask at 70 rpm, the mixture was reacted at temperature of 70° C. for 12 hours. The mixture was loaded in a great amount of methanol. The polymer was deposited to remove the residual monomers, and then centrifugalized to separate powder of the separated copolymer. The powder thus separated was dried, thus producing electric charge controlling resin SN-1. The SN-1 was then dispersed and dissolved in tetrahydrofuran (THF), and then loaded in a great amount of water. After deposited to the deepest depth, the SN-1 was sufficiently cleaned to remove the copolymerizable composition containing a great amount of units of styrene-sodium sulfonic acid. The SN-1 thus cleaned was again centrifugalized to take out an oil-soluble styrene-sodium sulfonic acid copolymer. The copolymer thus taken out was dried, thus producing electric charge controlling resin SN-2. Table 3 shows the concentrations of styrene-sodium sulfonic acid and the Rf values of the SN-1 and SN-2 as calculated based on an infrared absorption spectrum. FIG. 1 shows spots of the acquired copolymers as developed according to a thin-layer chromatography.

TABLE 3

| | SN-1 | SN-2 |
|---|---|---|
| Concentration of styrene-sodium sulfonic acid (% by weight) | 10.4 | 5.2 |
| Rf | 0 to 1.0 | 0.7 to 1.0 |

Example 6 (production of the first toner)

| (Component) | (Quantity) |
|---|---|
| SN-2 (Rf value: 0.7–1.0) | 24 parts by weight |
| Styrene-Acryl copolymer (Tg = 65, Mn = 10000, Mw = 120000) | 80 parts by weight |
| C.I. Solvent Blue 25 | 10 parts by weight |

According to the prescription above-mentioned, toner was prepared in the same manner as in Example 2. This toner presented the electrostatic charge of −40 μc/g as measured according to the blow-off method. The distribution curve of electrostatic charge was sharp with no toner particles presenting excessively great or small electrostatic charges.

Likewise, as in Example 2, a copying test was conducted on this toner. The image obtained was excellent in light permeability with a good image quality.

Comparative Example 2 (production of the first toner)

Toner was prepared in the same manner as in Example 6 except that 24 parts by weight of the SN-1 was used instead of the SN-2 used in Example 6.

This toner presented the electrostatic charge of −12 μc/g as measured according to the blow-off method. According to the distribution of electrostatic charge, there were observed many toner particles presenting excessive or reverse electrostatic charges.

Likewise, as in Example 2, a copying test was conducted on this toner. The image obtained was poor in light permeability and lacked clearness.

As apparent from the Examples and Comparative Examples above-mentioned, the DN-1 and the DN-2 were prepared under the same polymerization conditions except for the conditions of flask and charge amount, but present different Rf values serving as indexes of lipophilic property. The use of the DN-3 of which average molecular weight is lower than that of the DN-1 or DN-2, caused the materials to stick to the machine at the time of production. Nevertheless, the DN-3 may also produce toner excellent in the electrostatic chargeability and light permeability, likewise in Examples 2 and 3.

According to Example 6, the toner was prepared with the use of the SN-2 (presenting the Rf value in a range from 0.7 to 1.0) which had been obtained by dispersing and dissolving the SN-1 in the THF and by loading the SN-1 in water to remove the unnecessary copolymerizable composition. The toner of Example 6 may produce very good results. On the other hand, no toner was obtained with the use of the SN-1 of Comparative Example 2 (presenting the Rf value of 0.1 to 1.0) which remained containing the unnecessary copolymerizable composition.

It was understood that any toner as obtained with the use of the electric charge controlling resin presenting the Rf value in a preferred range, was good and that the production control using a thin-layer chromathography at the time of production of the electric charge controlling resin was very effective in checking the quality of toner produced on a full scale.

Example 7 (production of the second toner)

| (Component) | (Quantity) |
|---|---|
| DN-5 (Rf value: 0.94–0.99) | 10 parts by weight |
| Styrene | 60 parts by weight |
| Graphitized carbon black (MA-100 manufactured by Mitsubishi Kasei Co., Ltd.) | 5 parts by weight |
| Polypropylene of low molecular weight (BISCOL 550P manufactured by Sanyo Kasei Co., Ltd.) | 1.5 parts by weight |
| Initiator of polymerization (AIBN) | 4 parts by weight |

The components above-mentioned were mixed to produce a polymerizable composition.

Hydrochloric acid was added to a dispersion medium as obtained by mixingly adding 5.5 parts by weight of tribasic calcium phosphate and 0.01 part by weight of dodecyl-sodium benzenesulfonic acid to 400 parts by weight of distilled water, thereby to dissolve the tribasic calcium phosphate. The polymerizable composition containing the DN-5 was added to the dispersion medium in which the tribasic calcium phosphate had been dissolved. While the resultant mixture was stirred at 8000 rpm for 15 minutes with the TK Homomixer (manufactured by Tokusyukika Kogyo Co., Ltd.), sodium hydroxide was added to this mixture so that the tribasic calcium phosphate was separated and the polymerizable composition above-mentioned was suspended. The suspension was transferred to a separable flask and subjected to normal stirring at 80° C. under a stream of nitrogen to achieve polymerization for 5 hours.

Figure 4:
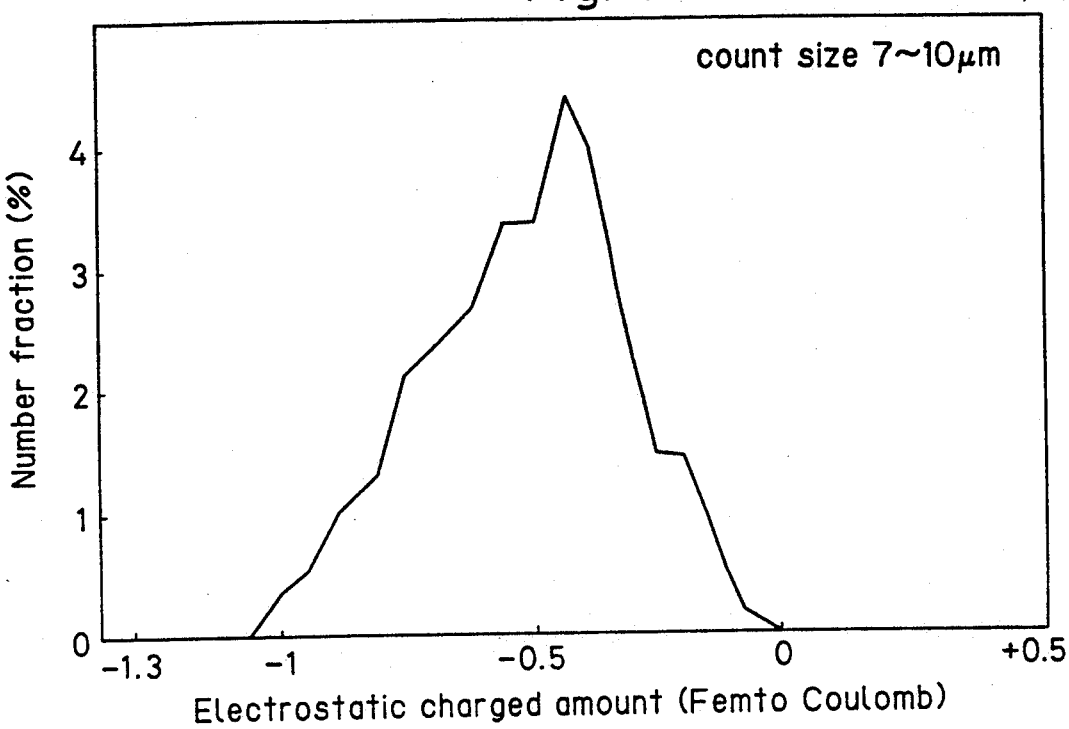
FIGS. 4 and 5 are graphs illustrating the electrostatic charge distribution curves of the toners of Example 7 and Comparative Example 3, respectively.

The resultant particles were taken out. The particles thus taken out were treated with dilute acid and washed with water. The particles thus washed were dried, thus producing toner. According to the particle size distribution of this toner as measured with a coulter counter, the volumetric average particle size was 9.5 μm and fine particles having a particle size of 5 μm or less were contained at a ratio of 0.5% or less. The toner and a ferrite carrier were mixed and then electrostatically charged by friction. The toner electrostatic charge as measured by the blow-off method was −44 μc/g. Likewise, as in Example 2, the distribution of electrostatic charge of this developer was measured with apparatus for measuring the electrostatic charge of toner. The distribution of electric charge thus measured was very sharp without non-charged or reversely charged toner particles, as shown in FIG. 4.

Example 8 (production of the second toner)

Toner was prepared by suspension polymerization in the same manner as Example 7 except for the use of 24 parts by weight of the DN-6 (Rf value of 0.92 to 0.97) instead of the DN-5 used in Example 7, and 46 parts by weight instead of 60 parts by weight of styrene, and the additional use of 30 parts by weight of n-butylmethachlylate. The distribution of particle size of this toner was measured with a coulter counter. According to the measurement result, the volumetric average particle size was 9.8 μm and fine particles having a particle size of 5 μm or less were contained at a ratio of 0.6% or less.

The electrostatic charge of this toner as measured by the blow-off method was −40μc/g. The distribution curve of electrostatic charge was very sharp without non-charged or reversely charged toner particles shown.

Example 9 (production of the second toner)

Toner was prepared in the same manner as in Example 7 except that 10 parts by weight of the DN-7 ($Mw=8.7\times10^5$) (Rf value: 0.86 to 0.99) was used instead of the DN-5 ($Mw=2.6\times10^3$) used in Example 7, the DN-7 having a greater molecular weight than that of the DN-5. The viscosity of the polymerizable composition became high. Hydrochloric acid was added to a dispersion medium as obtained by mixing and adding 7.0 parts by weight of tribasic calcium phosphate and 0.02 part by weight of dodecyl-sodium benzenesulfonic acid to 400 parts by weight of distilled water, thereby to dissolve the tribasic calcium phosphate. The polymerizable composition containing the DN-7 was added to the dispersion medium in which the tribasic calcium phosphate had been dissolved. The resultant mixture was suspended and polymerized at 9000 rpm with the TK Homomixer (manufactured by Tokusyukika Kogyo Co., Ltd.), thereby to produce toner. According to the distribution of toner particle sizes as measured, the volumetric average particle size was 9.8 μm and fine particles having 5 μm or less were contained at a ratio of 0.6% or less. The electrostatic charge of the toner as measured by the blow-off method, was −40 μc/g. The distribution curve of electrostatic charge was very sharp without non-charged or reversely charged toner particles shown.

Comparative Example 3 (production of the second toner)

Toner was prepared by suspension polymerization in the same manner as in Example 8 except that 10 parts by weight of the DN-4 (Rf value of 0.42 to 0.99) was used in Comparative Example 3. After completion of the polymerization, the suspension was observed with a light microscope, and it was found that the particles having a particle size of about 10 μm prior to polymerization had been reduced in particle size to 8 μm. The particles were then treated with dilute acid and washed with water until emulsion-polymerized particles disappeared. The particles thus washed were then dried, thus producing toner.

Figure 5:
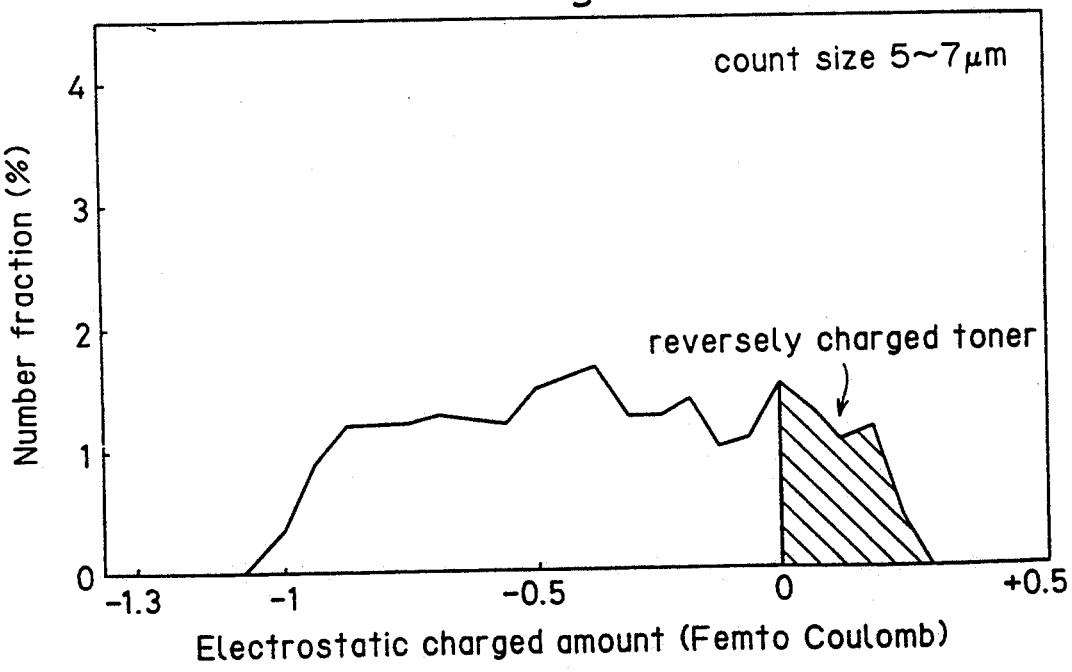

The toner electrostatic charge as measured by the blow-off method was as low as −10 μc/g. The distribution of electrostatic charge showed a great number of reversely charged or non-charged toner particles, as shown in FIG. 5. The toner yield was equal to 50%.

Example 10 (production of the second toner)

| (Component) | (Quantity) |
|---|---|
| SN-2 (Rf value of 0.7 to 0.99) | 24 parts by weight |
| Styrene | 46 parts by weight |
| n-butylmethacrylate | 30 parts by weight |
| Graphitized carbon black (MA-100 manufactured by Mitsubishi Kasei Co., Ltd.) | 5 parts by weight |
| Polypropylene of low molecular weight (BISCOL 550P manufactured by Sanyo Kasei Co., Ltd.) | 1.5 part by weight |
| Initiator of polymerization (AIBN) | 4 parts by weight |

The components above-mentioned were mixed to prepare a polymerizable composition.

Hydrochloric acid was added to a dispersion medium as obtained by mixing and adding 5.5 parts by weight of tribasic calcium phosphate and 0.01 part by weight of dodecyl-sodium benzenesulfonic acid to 400 parts by weight of distilled water, thereby to dissolve the tribasic calcium phosphate. The polymerizable composition containing the SN-2 was added to the dispersion medium in which the tribasic calcium phosphate had been dissolved. While the resultant mixture was stirred at 8000 rpm for 15 minutes with the TK Homomixer (manufactured by Tokusyukika Kogyo Co., Ltd.), sodium hydroxide was added to this mixture so that the tribasic calcium phosphate was separated and the polymerizable composition above-mentioned was suspended. The suspension was transferred to a separable flask and subjected to normal stirring at 80° C. under a stream of nitrogen to achieve polymerization for 5 hours. The resultant particles were taken out. The particles thus taken out were treated with dilute acid and washed with water. The particles thus washed were dried, thus producing toner.

According to the particle size distribution of this toner as measured, the volumetric average particle size was 8.4 μm and fine particles having a particle size of 5 μm or less were contained at a ratio of 0.6% or less. The toner electrostatic charge as measured by the blow-off method was −32 μc/g. According to the result of measurement, the distribution curve of electrostatic charge was very sharp without non-charged and reversely charged toner particles shown.

Comparative Example 4 (production of the second toner)

In the same manner as in Example 10, a polymerizable composition was prepared with the use of the SN-1 (Rf value of 0 to 1.0) instead of the SN-2 used in Example 10. Likewise, as in Example 10, hydrochloric acid was added to a dispersion medium as obtained by mixing and adding 5.5 parts by weight of tribasic calcium phosphate and 0.01 part by weight of dodecylsodium benzenesulfonic acid to 400 parts by weight of distilled water, thereby to dissolve the tribasic calcium phosphate. The polymerizable composition containing the SN-1 was added to the dispersion medium in which the tribasic calcium phosphate had been dissolved. While the resultant mixture was stirred at 6000 rpm for 15 minutes with the TK Homomixer (manufactured by Tokusyukika Kogyo Co., Ltd.), sodium hydroxide was added to this mixture so that the tribasic calcium phosphate was separated and the polymerizable composition above-mentioned was suspended.

When the suspension was observed with a optical microscope, it was found that all particles having a particle size of about 8 μm before polymerization had disappeared. Even though treated with dilute acid, washed with water and dried, the particles could not be used as toner.

As apparent from Examples 7 to 10 and Comparative Examples 3 to 4, the DN-5 and the DN-6 were prepared under the same polymerization conditions except for the conditions of flask and charge amount, but present different Rf values serving as indexes of lipophilic property. The use of the DN-7 of which average molecular weight is higher than that of the DN-5 or DN-6, caused the viscosity of the polymerizable composition to become higher. However, by increasing the stirring speed and the amounts of the dispersion stabilizer and the surface active agent, it was possible to prepare toner presenting a sharp distribution of particle size and good electrostatic chargeability without emulsion particles produced, likewise in Examples 7 and 8 using the DN-5 and DN-6, respectively.

According to Example 10, the toner was prepared with the use of the SN-2 (presenting the Rf value in a range from 0.7 to 1.0) which had been obtained by dispersing and dissolving the composition in the THF and by loading the composition in water to remove the unnecessary copolymerizable composition. The toner of Example 10 produced very good results. On the other hand, no toner was obtained with the use of the SN-1 of Comparative Example 4 (presenting the Rf value of 0 to 0.99) which remained containing the unnecessary copolymerizable composition.

It was understood that any toner as obtained with the use of the electric charge controlling resin presenting the Rf value in a preferred range, was good and that the production control using a thin-layer chromatography at the time of production of the electric charge controlling resin was very effective in checking the quality of toner produced on a full scale.

Figure 6:
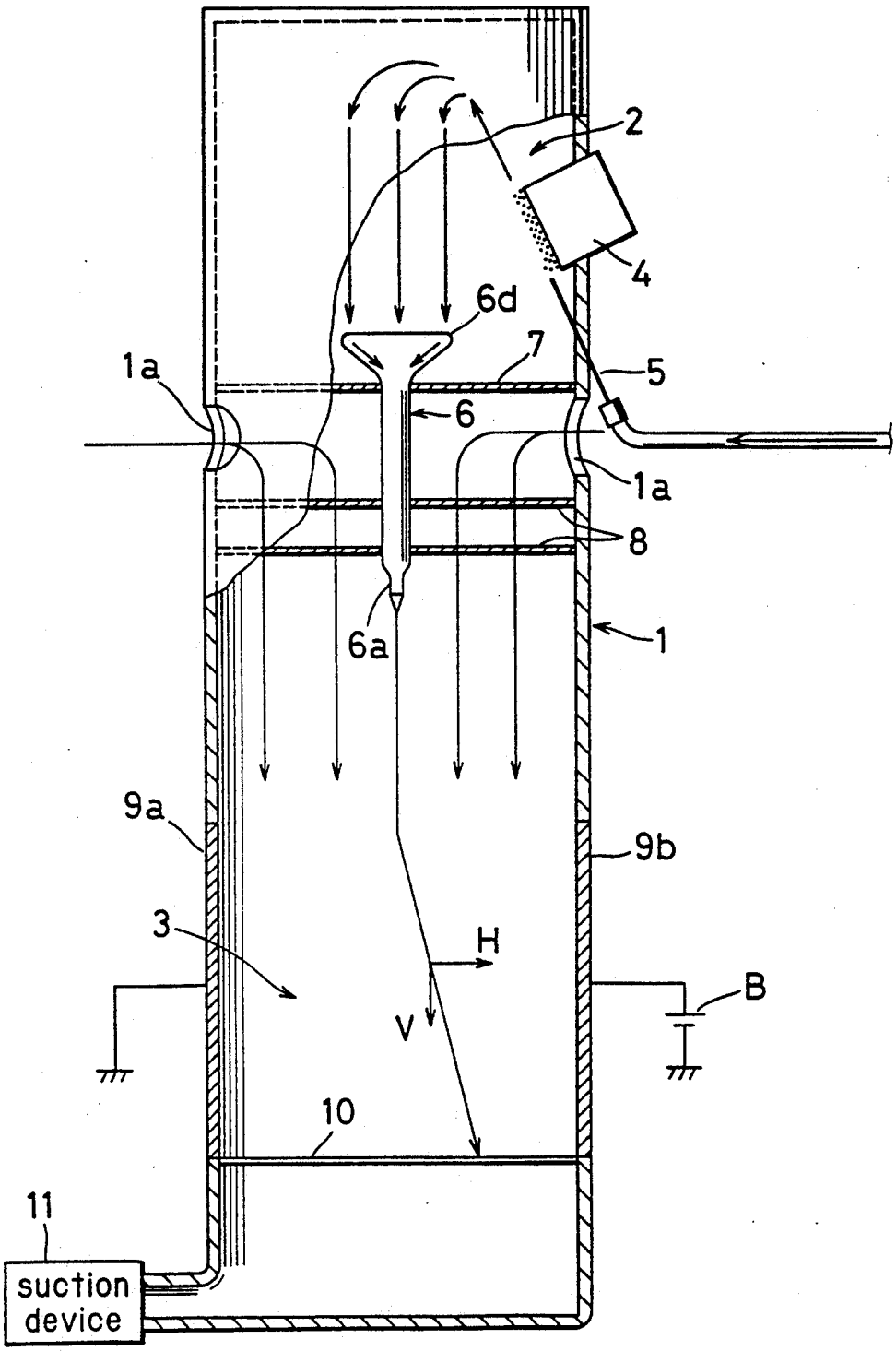
FIG. 6 is a section view of apparatus for measuring the electrostatic charge of toner.

FIG. 6 shows apparatus for measuring the distribution of toner electrostatic charge used for Examples and Comparative Examples above-mentioned.

As shown in FIG. 6, this apparatus is provided in a cylindrical housing 1 thereof with a separation unit 2 for separating toner from a developer, a counting unit 3 for measuring the distribution of electrostatic charge of separated toner, and a suction device 11 such as an air pump or the like.

The separation unit 2 and the counting unit 3 are divided from each other by a partition plate 7. At a position slightly lower than the position of this partition plate 7, the lateral wall of the housing 1 has communication holes 1*a* for introducing air into the housing 1. Air flow arranging filters 8 are disposed at positions slightly lower than the positions of the communication holes 1*a*.

In the separation unit 2, compressed air is blown to a developer as held on a magnet 4 by an air needle 5, so that light-weight toner alone is blown up and scattered with a carrier magnetically adsorbed by the magnet 4 remaining thereon.

A funnel 6 as supported by the partition plate 7 is disposed between the separation unit 2 and the counting unit 3. The funnel 6 has, at the upper end thereof, a receiving port 6*d* which projects upwardly from the partition plate 7. The funnel 6 has, at the lower end thereof, a tapering portion 6*a* which passes through the filters 8 and faces the counting unit 3.

In the counting unit 3, a D.C. source supply B is applied to a pair of electrode rods 9*a*, 9*b* embedded in the lateral wall of the housing 1, thereby to form horizontal parallel electric fields between the electrode rods 9*a*, 9*b*. A filter 10 is also disposed.

The suction device 11 is adapted to form not only a main flow of air which is introduced from the outside of the housing 1 and which flows to the counting unit 3 through the communication holes 1*a* and the air flow arranging filters 8, but also a flow of air adapted to suck the toner into the funnel 6, the last-mentioned air flow being formed above the funnel 6.

According to the apparatus having the arrangement above-mentioned, toner particles separated by the separation unit 2, collected by the funnel 6 and introduced into the counting unit 3, are adapted to fall perpendicularly along the air flows formed by the suction device 11. The toner particles then reach the filter 10 through the gap between the electrode rods 9*a*, 9*b*. At this time, each of the toner particles falls while receiving, in the horizontal parallel electric fields between the electrode rods 9*a*, 9*b*, vertical gravity V and a horizontal Coulomb's force H according to the electrostatic charge. Accordingly, each toner particle is dispersed, on the filter 10, to the position corresponding to the mass and electrostatic charge thereof. Based on the distribution of toner particle falling positions, the distribution of toner electrostatic charge may be calculated by an image processing. With this apparatus, there may be obtained the number fraction of electrostatic charge per toner particle in each of the ranges of particle size (2 to 5 μm, 5 to 7 μm, 7 to 10 μm, and 10 to 15 μm.

What is claimed is:

1. An electric charge controlling resin comprising a polymer obtained by copolymerization between at least one oil-soluble monomer selected from a group consisting of a vinyl aromatic hydrocarbon monomer, an acrylic monomer, a vinyl ether monomer, a diolefin monomer and a monoolefin monomer, and at least one water-soluble monomer, wherein the water-soluble monomer is a sodium styrene sulfonate, said polymer being adjusted such that a flow rate, Rf, is in the range from 0.5 to 1.0, as measured by thin layer chromatography wherein a silica gel is used as an absorbent and ethyl acetate is used as a developing solvent.

2. A toner including a binding resin and the electric charge controlling resin according to claim 1 dispersed in the binding resin.

3. An electric charge controlling resin according to claim 1, wherein said polymer is obtained by a dispersion polymerization in a mixture medium of water and a water-miscible organic solvent and in the presence of a dispersion stabilizer.

4. An electric charge controlling resin according to claim 1, wherein said polymer is dissolved in a water-soluble organic solvent to form a resultant solution, and the resultant solution is loaded into water, such that said flow rate is within the range of 0.5 to 1.0.

5. A toner comprising spheric particles, which particles are obtained by a method comprising the steps of dispersing said electric charge controlling resin of claim 1 with coloring agents in a radically polymerizable monomer capable of forming a binding resin, suspending the obtained radically polymerizable composition in water, forming oil drop particles having sizes in the range of 5 to 30 μm, and polymerizing the composition in the presence of an initiator of radical polymerization.

6. An electric charge controlling resin as in claim 1, wherein said flow rate is in the range of 0.7 to 1.0.

7. A method for producing a toner, comprising:

dispersing an electric charge controlling resin with a coloring agent in a radically polymerizable monomer capable of forming a binding resin, said electric charge controlling resin obtainable by copolymerization between at least one oil-soluble monomer selected from a group consisting of a vinyl aromatic hydrocarbon monomer, an acrylic monomer, a vinyl ether monomer, a diolefin monomer and a monoolefin monomer, and at least one water-soluble monomer, wherein said water-soluble monomer is a sodium styrene sulfonate, said polymer being adjusted such that a flow rate, Rf, is in the range from 0.5 to 1.0, as measured by thin layer chromatography, wherein a silica gel is present as an absorbent and ethyl acetate is present as a developing solvent;

suspending the radically polymerizable monomer in water;

forming oil drop particles having particle sizes in the range of 5 to 30 μm; and polymerizing the particles in the presence of an initiator of radical polymerization.

* * * * *